US005178532A

United States Patent [19]

Frigiere

[11] Patent Number: 5,178,532

[45] Date of Patent: Jan. 12, 1993

[54] ELECTRICAL IGNITER FOR GAS LIGHTER

[75] Inventor: Rene Frigiere, Charbonnieres les Bains, France

[73] Assignee: Societe Anonyme Cricket, La Pape, France

[21] Appl. No.: 780,914

[22] Filed: Oct. 22, 1991

[30] Foreign Application Priority Data

Nov. 7, 1990 [FR] France ..... 90 14111

[51] Int. Cl.[5] ..... F23Q 1/04

[52] U.S. Cl. ..... 431/254; 431/130; 431/258; 431/256

[58] Field of Search ..... 431/255, 258, 256, 257, 431/128, 129, 254, 132, 130; 361/253, 255, 258, 261

[56] References Cited

U.S. PATENT DOCUMENTS 3,439,995 4/1969 Hattori et al. .

FOREIGN PATENT DOCUMENTS 1451412 6/1969 Fed. Rep. of Germany .
2573516 1/1989 France .
6191419 12/1989 Japan .
2169068 7/1986 United Kingdom ..... 431/255

OTHER PUBLICATIONS

Search Report issued by French Patent Office in priority application (Ser. No. 90 14111), listing the above publications.

*Primary Examiner*—Larry Jones
*Attorney, Agent, or Firm*—Herbert Dubno; Andrew Wilford

[57] ABSTRACT

A gas appliance has a housing, a reservoir of a gasifiable combustible in the housing, and a nozzle in the housing connected to the reservoir provided with a valve openable for emitting an ignitable stream of the combustible. An igniter in the housing has a relatively stationary first generator part forming a first terminal, a first electrode at the nozzle connected to the first terminal, and a relatively movable second generator part forming a second terminal and movable on the stationary part to generate a potential between the terminals. A depressible button or element displaceable on the housing between upper and lower end positions is connected to the movable generator part for opening the valve and generating the potential between the terminals when moving into the lower end position. A second electrode wholly formed of an elastically deformable conductive metal wire fixed in the housing has one end juxtaposed with the first electrode at the nozzle and another end engageable with the second terminal on the movable part generally on displacement of same into the lower end position.

5 Claims, 2 Drawing Sheets

ELECTRICAL IGNITER FOR GAS LIGHTER

FIELD OF THE INVENTION

The present invention relates to an electrical igniter for a portable gas appliance. More particularly this invention concerns such an igniter useable in a gas lighter.

BACKGROUND OF THE INVENTION

A standard gas appliance such as a smoker's lighter has a housing, a reservoir of a gasifiable combustible in the housing, and a nozzle in the housing connected to the reservoir and provided with a valve openable for emitting an ignitable stream of the combustible. A piezoelectric igniter in the housing has a relatively stationary generator part connected to an electrode at the nozzle and a relatively movable generator part connected to another electrode adjacent the nozzle electrode and movable on the stationary part to generate a potential between the electrodes. The stationary part can normally move somewhat to open the valve of the reservoir just before the spark is generated.

In such an appliance as described in U.S. Pat. No. 3,439,995 of H. Tadamichi and German patent document 1,451,412 of Mellert a depressible element connected to the movable generator part opens the valve and generates a spark between the electrodes in that order as it is depressed. The spark ignites the stream of gas emitted by the nozzle and as long as the element remains depressed the valve will remain open and the flame will burn.

It is standard in such an arrangement for one of the electrodes to be formed by the nozzle itself, typically by making it at least partially of conductive material and connecting it to the generator terminal of the relatively fixed part. The other nozzle can be a conductive element fixed in the housing adjacent the nozzle and connected as described in French patent 2,573,616 of H. Sadoya by a flexible wire to the other terminal which is on the more movable part of the piezoelectric sparker. Such an arrangement is fairly complicated and difficult to manufacture, especially for a throwaway item like a cigarette lighter.

In Japanese patent 57,251/89 of Kokai the second electrode is engaged by a wiper on the more movable igniter part as same is depressed. Such a construction demands fairly tight tolerances to ensure proper electrical contact. The connection must be made without the structure blocking depression of the lighter button and without leaving such a gap that no current can flow. Obviously this high-tolerance construction again elevates manufacturing costs.

OBJECTS OF THE INVENTION

It is therefore an object of the present invention to provide an improved electrical igniter for a portable gas-burning appliance.

Another object is the provision of such an improved igniter for a portable gas-burning appliance which overcomes the above-given disadvantages, that is which is fairly simple in construction but sure in operation.

SUMMARY OF THE INVENTION

A gas appliance according to the invention has a housing, a reservoir of a gasifiable combustible in the housing, and a nozzle in the housing connected to the reservoir provided with a valve openable for emitting an ignitable stream of the combustible. An igniter in the housing has a relatively stationary first generator part forming a first terminal, a first electrode at the nozzle connected to the first terminal, and a relatively movable second generator part forming a second terminal and movable on the stationary part to generate an electric potential between the terminals. A depressible button or element displaceable on the housing between upper and lower end positions is connected to the movable generator part for opening the valve and generating the potential between the terminals when moving into the lower end position. According to the invention a second electrode wholly formed of an elastically deformable conductive metal wire fixed in the housing has one end juxtaposed with the first electrode at the nozzle and another end engageable with the second terminal on the movable part generally on displacement of same into the lower end position.

The use of an elastically deformable spring-steel wire is an extremely inexpensive system that can be built to fairly loose tolerances and still function perfectly. The cost of the lighter will be maintained low.

In accordance with the invention the wire is spring steel and extends perpendicular to the depression direction of the element through a partition in the housing, which partition itself extends parallel to the button displacement direction. More particularly, the second electrode is formed by a springsteel coil spring and the second terminal engages and enters into contact with the second electrode shortly before the button reaches its lower end positions. Thus as the button is depressed first the valve is opened, then the spark is generated, and finally the button bottoms on the housing.

Furthermore according to the invention the second terminal projects laterally from the second generator part and is formed with a seat that complementarily engages over the wire as the second part moves into its lower end position. This seat is downwardly concave and open.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
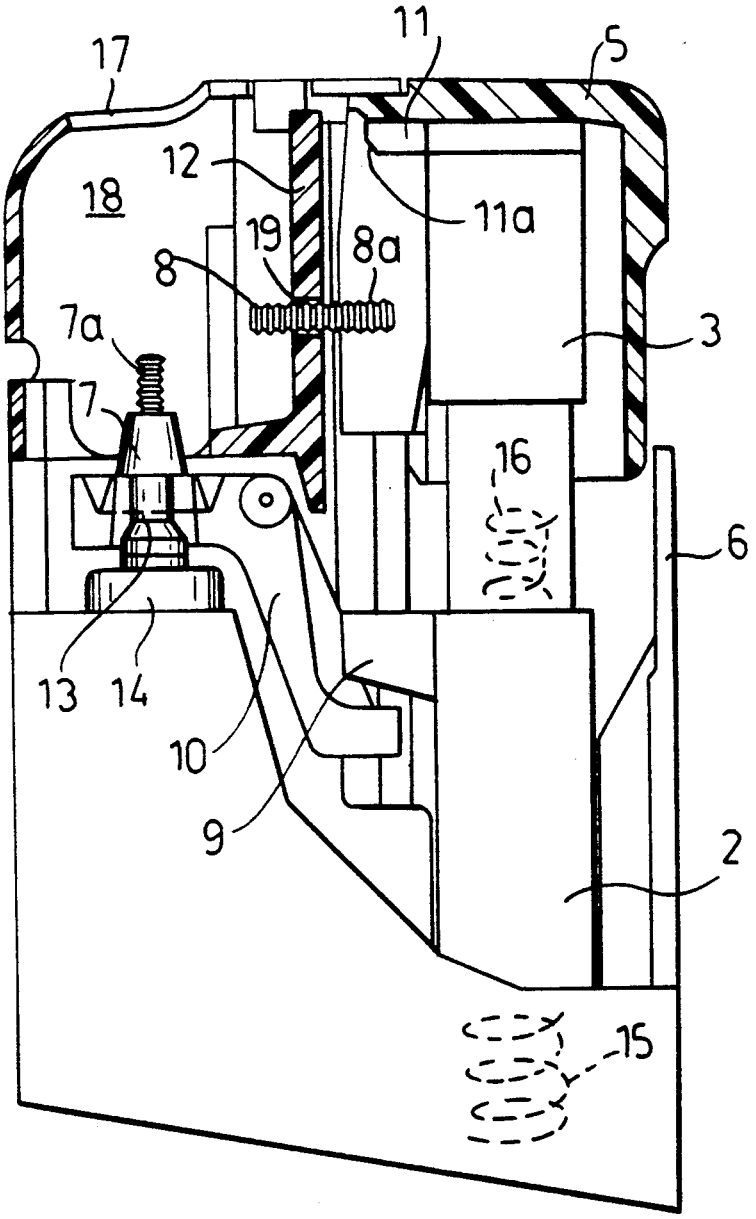
FIG. 1 is a partly diagrammatic large-scale and partly sectional side view of the upper end of the lighter of this invention in the unactuated position.

As seen in FIG. 1 a lighter according to this invention has a body or housing 6 in which is contained a reservoir partly shown at 14 and filled with a gasifiable combustible liquid. A valve 13 on the reservoir 14 can be opened to emit a stream of the gas from a nozzle 7. The housing 6 is formed in line with the nozzle 7 with an aperture 17 so that, when the gas stream emitted by the nozzle 7 is ignited as described below, the flame will issue from the housing 6 at 17.

Figure 2:
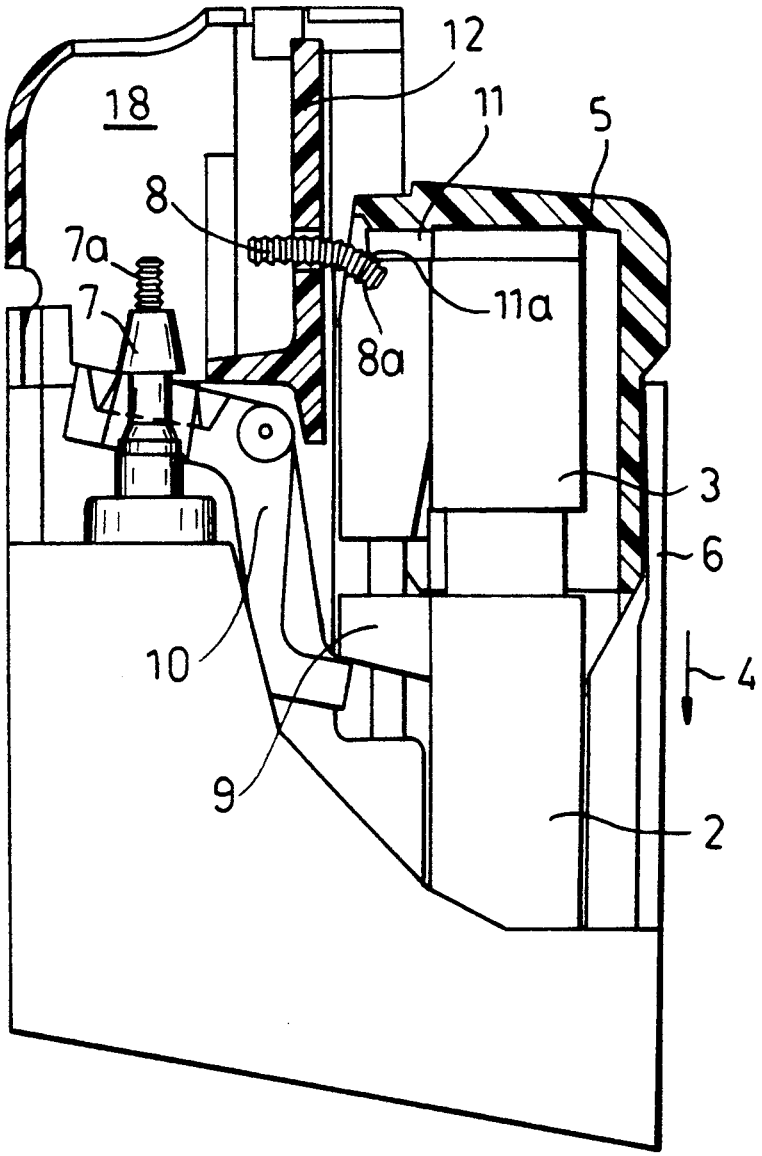
FIG. 2 is a view like FIG. 1 but in the actuated position.

A piezoelectric spark generator has a stationary or slightly movable base part 2 supported in the housing 6 on a relatively weak spring 15 and a movable upper part 3 supported on the base part on a relatively strong spring 16 and held on a depressible button 5 forming part of the housing 6. This spark generator is provided With internal structure that is loaded by the spring 16 so that a hammer strikes a crystal and generates a spark between a terminal 9 on the part 2 and another terminal 11 projecting laterally from the movable part 3 once the part 3 is pushed down as indicated by arrow 4 in FIG. 2 beyond a certain intermediate position.

The base part 2 engages with the terminal 9 on one end of a pivotal two-arm lever 10 whose other end engages under the valve 13 so that a the base part 2 is pushed down the valve 13 is opened and gas issues from the nozzle 7. The spring 15 is softer than the spring 16 so that the nozzle 7 is opened before the spark is generated. The nozzle 7 is conductive and is in part formed by a steel spring 7*a* that acts as an electrode.

The housing 6 is formed between the generator 2, 3 and the chamber 18 surrounding the nozzle 7 with a partition 12 having a throughgoing hole 19 through which extends an electrode 8 formed by a coil spring 8*a*. The terminal 11 projects laterally of the depression direction 4 toward the partition 1 and is formed with a rounded cutout or seat 11*a* which engages over the spring 8*a* before the button 5 reaches the bottom or fully depressed position of FIG. 2, and before the spring 16 fires the generator and creates a fairly high-voltage potential between the terminals 9 and 11. Thus when this potential is created the valve 13 will be opened, gas will issue from the nozzle, 7, and the only path for the current to flow along will be as a spark in the air between the nozzle/electrode 7 and the electrode 8. This spark will ignite the emitted gas to create a flame which will burn until the button is released and the valve 13 is closed.

I claim:

1. A gas appliance having:

a housing;

a reservoir of a gasifiable combustible in the housing;

a nozzle in the housing connected to the reservoir and provided with valve means openable for emitting an ignitable stream of the combustible;

a relatively stationary first generator part forming a first terminal;

a first electrode at the nozzle connected to the first terminal;

a relatively movable second generator part forming a second terminal and movable on the stationary part from an upper end position to a lower end position to generate a potential between the terminals;

means including a depressible element displaceable between upper and lower end positions and connected to the movable generator part for opening the valve means and generating the potential between the terminals when moving into the respective lower end position; and a second electrode wholly formed of an elastically deformable coil spring fixed in the housing and having one end juxtaposed with the first electrode at the nozzle and another end engageable with the second terminal on the movable part generally only on displacement of same into the respective lower end position and being out of engagement with the second terminal in the upper end position of the movable part.

2. The gas appliance defined in claim 1 wherein the spring is spring steel.

3. The gas appliance defined in claim 1 wherein the second terminal engages and enters into contact with the second electrode shortly before the depressible element reaches its lower end position and is otherwise out of contact with the second terminal.

4. The gas appliance defined in claim 3 wherein the second terminal projects laterally from the second generator part and is formed with a seat that complementarily engages over the wire as the second part moves into its lower end position.

5. The gas appliance defined in claim 4 wherein the seat is downwardly concave and open.

* * * * *